US005661814A

United States Patent [19]

Kälin et al.

[11] Patent Number: 5,661,814

[45] Date of Patent: Aug. 26, 1997

[54] HEARING AID APPARATUS

[75] Inventors: August Nazar Kälin, Bonstetten; Pius Gerold Estermann, Unterschachen; Bohumir Uvacek, Herrliberg, all of Switzerland

[73] Assignee: Phonak AG, Stäfa, Switzerland

[21] Appl. No.: 335,180

[22] Filed: Nov. 7, 1994

[30] Foreign Application Priority Data

Nov. 10, 1993 [EP] European Pat. Off. ..... 93118186

[51] Int. Cl.[6] ..... H04R 25/00

[52] U.S. Cl. ..... 381/68.2; 381/68.4; 381/83; 381/93

[58] Field of Search ..... 381/83, 93, 71, 381/68.2, 68.4

[56] References Cited

U.S. PATENT DOCUMENTS 4,631,749 12/1986 Rapaich ..... 381/122

4,658,426 4/1987 Chabries et al. ..... 381/93

4,815,139 3/1989 Eriksson et al. ..... 381/71

5,347,586 9/1994 Hill et al. ..... 381/71

5,444,786 8/1995 Raviv ..... 381/71

*Primary Examiner*—Forester W. Isen

*Attorney, Agent, or Firm*—Notaro & Michalos P.C.

[57] ABSTRACT

The acoustical-mechanical disturbance feedback between the electrical-acoustical converter and the acoustical-electrical converter of a hearing aid apparatus is compensated by means of an adaptive compensator filter which feeds back a signal derived from the output of an amplification filter to its input. At the input side thereby the signal from the acoustical-to-electrical converter and the output signal of the adaptive compensator filter are substracted at a difference forming unit, the output of which being led to the input of the amplification filter. The difference is thereby formed in time domain, and time domain to frequency domain transform is performed at the output side of the difference forming unit, accordingly inverse frequency domain to time domain transform at the electric input side of the electrical-to-acoustical converter.

40 Claims, 11 Drawing Sheets

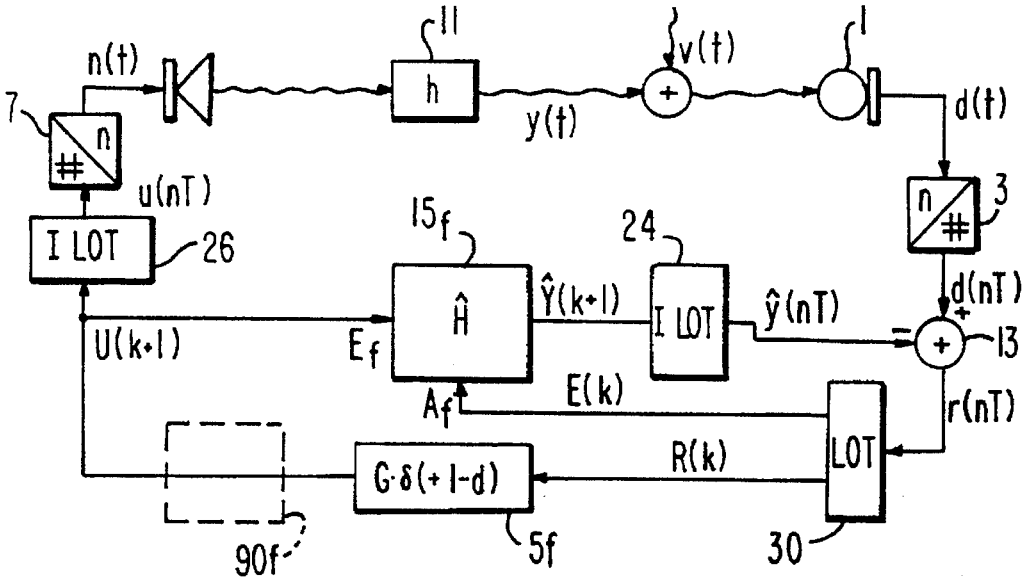
FIG.5
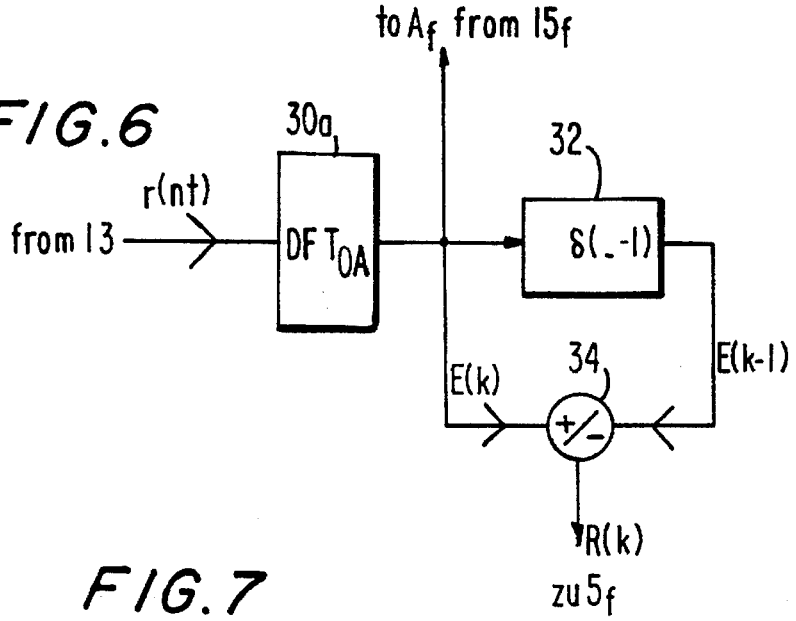
FIG.6
FIG.7
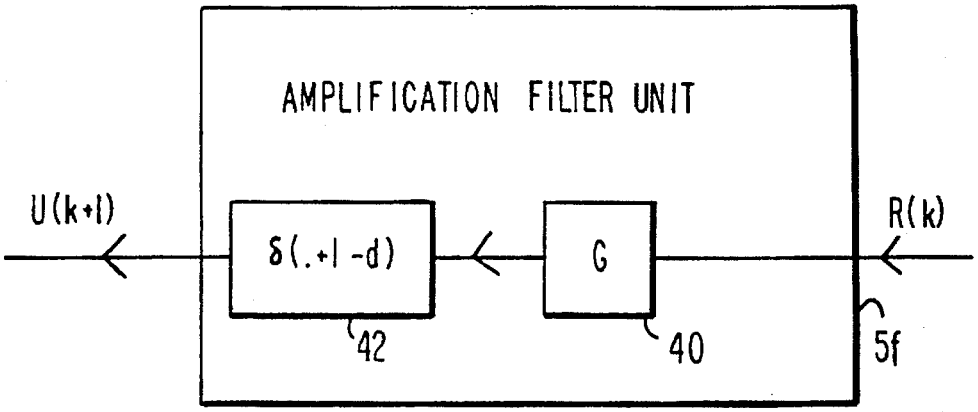

HEARING AID APPARATUS

BACKGROUND OF THE INVENTION

1. Field of the Invention

The present invention is generally directed to hearing aid technology, more specifically the present invention deals with problems which occur due to acoustical-mechanical feedback from an electrical-to-acoustical converter of hearing aid apparatus to its acoustical-to-electrical converter.

2. Description of Prior Art

The problems which occur due to acoustical-mechanical feedback between the electrical-to-acoustical converter—EAC—and the acoustical-to-electrical converter—AEC—of hearing aid apparatus are known and are e.g. described in the EP-A-0 415 677 according to the U.S. Pat. No. 5,259,033 which documents shall form an integral part of the present description with respect to the mentioned problems.

An attempt to resolve these problems is schematically shown in FIG. 1 which shows a prior art hearing aid apparatus.

Definition

Throughout the present description, two points of an electric circuit are considered to be "operationally connected" whenever an electric signal at one of these two points is dependent from the electric signal at the second of these points, This irrespective of whether a direct connection of the two points is installed or whether the electric signal between the two points is led through signal treating units which change the signal transmitted from the first to the second point. Such changes may be amplification, filtering, superposition, time domain to frequency domain transform, frequency domain to time domain inverse transform etc.

According to FIG. 1, a prior art hearing aid apparatus comprises an AEC 1, the output of which being operationally connected to the input of an analog-to-digital converter—ADC—3. A digital amplification filter unit 5 is operationally connected with its output to a digital-to-analog converter—DAC—7, which latter is operationally connected with its output to the input of EAC 9.

With the block 11 in FIG. 1, the acoustical mechanical disturbance feedback is shown with a transmission characteristic h, which is generally varying in time. The feedback signal y(t) is superimposed to the acoustical signal v(t) to be amplified by the hearing aid apparatus. The superposition result acts on the input of the AEC 1, which, at its output, generates the signal d(t) in time domain as a basis for generating time discrete sampling values d(nT) at the ADC 3 with time intervals nT.

For suppression of the disturbing feedback signal y(t), e.g. in D. K. Bustamante et al., "Measurement and adaptive suppression of acoustic feedback in hearing aids", Proc. 1989, IEEE, ICASSP, 3:2017–2020, 1989, it has been proposed to provide a difference forming unit 13 and a compensator filter unit 15. The compensator filter unit 15 generates from the output signal of the amplification filter unit 5, by means of filtering with an m-stage finite impulse response filter, an estimate signal $\hat{y}(nT)$, which is fed to the difference forming unit 13. Thereby, making use of the well-known "least mean square" algorithm, the coefficients of the filter of compensator filter unit 15 are iteratively adjusted, so that the difference signal e(nT) at the output of difference forming unit 13 becomes not anymore correlated with the estimate signal $\hat{y}(nT)$. The compensator filter unit 15 thereby comprises an adaption control input A to which the signal e(nT) is fed for adaption control of the filter coefficients.

Under presumption of uncorrelated signal v(t), thus of v(nT) (digitalized), and of the amplified signal u(t) and thus of u(nT) at the output of amplifier filter unit 5, which is reached by appropriate selection of the time-lag DT at the digital amplifier filter of the unit 5, it becomes possible to rise the gain of the amplifier filter unit 5 by 6 to 10 dB compared with such gain at a hearing aid apparatus without adaptive compensator filter unit 15.

Nevertheless, this approach has the drawback that, with an assured length of the filter of adaptive compensator filter unit 15 of m-stages, a number of 2 m multiplication operations per sample at the ADC 3 are necessary. This leads to a very bulky system, especially considering the miniaturization which is necessary for hearing aid apparatus implementation.

At the system shown in FIG. 1, it is further necessary that the step width μ of the LMS algorithm is kept as small as possible to achieve speed signal transmission, so that adaption of the adaptive compensator filter unit 15 to the disturbance feedback 11 becomes accordingly slow. It follows therefrom that the possible increase of gain at the amplifier filter unit 5 is restricted due to stability limits.

As an improvement of this known approach, according to FIG. 1, a further attempt was to couple into the system a stationar measuring signal as is known e.g. from "Feedback cancellation in hearing aids: Results from a computer simulation", J. M. Kates, IEEE, Trans.on Signal Processing, Vol. 39, No, 3, March 1991, or from the EP-A-0 415 677 (U.S. Pat. No. 5,259,033). As a stationar measuring signal, a noise signal was coupled into the system.

It is a drawback of this improved approach that a generator for the measuring signal must be provided with an amplitude control to ensure a sufficient signal-to-noise ratio.

By the last mentioned attempt and with a compensator filter of 32nd order, an increase of gain at the amplifier filter unit 5 by approximately 17 dB became possible.

Due to the drawbacks of the last mentioned attempt with measuring signal coupling, a further approach as shown in FIG. 2 became known, according to "Integrated Frequency-Domain Digital Hearing Aid With the Lapped Transform", S. M. Kuo and S. Voepel, Electronics Letters, vol. 28, no. 23, November 1992.

According to this approach, the signal treatment is performed in the frequency domain at the amplifier filter unit 5 and at the adaptive compensator filter unit 15, according to FIG. 1. The output signal of the ADC 3 is transformed from time domain into frequency domain by means of an overlapping orthogonal transform (LOT) at a transform unit 17. An according inverse transform (ILOT) at an inverse transform unit 19 generates for the input of the EAC 7 the time domain signal u(nT) as necessary.

Because, when selecting a suitable time domain to frequency domain transformation, especially the discrete Fourier Transform (DFT) or the discrete Hartley Transform (DHT), the convolution at the adaptive compensator filter unit $15_f$ and at the amplifier filter unit $5_f$, when transiting into the frequency domain becomes a multiplication, this approach results principally in a reduction of calculation effort, and thus of hardware installation. Nevertheless, structuring of the discrete signal d(nT) at the input of the transform unit 17 into blocks of predetermined length is necessary. Thereby the errors due to such block separation and compared with conventional convolution may not be eliminated with a lapped block separation at the apparatus as shown in FIG. 2. Such errors lead to a time varying system, even then, when the disturbance feedback h and thus the adaptive compensation filter unit $15_f$ would be considered to be time invariant. The system remains time variant even if the disturbing feedback and its compensation are frozen.

Therefore, a compromise had to be made by selecting long block lengths of e.g. 512 sampling values. This led to an inefficient compensation via the adaptive compensation filter unit $15_f$. Accordingly, the practicable gain increase at the amplifier filter unit $5_f$ reins below 10 dB.

SUMMARY OF THE INVENTION

It is an object of the present invention to provide a hearing aid apparatus which keeps the advantages of signal treatment in the frequency domain, ensures time invariance of the system at a time varying disturbing feedback, allows to minimalize calculation and hardware installation to such an extent that signal treatment may be performed under the restricted volume conditions when realizing hearing aid apparatus.

This object is resolved by the hearing aid apparatus which comprises an acoustical-to-electrical—AEC—converter with an output, an electrical-to-acoustical—EAC—converter with an input.

an analog-to-digital—ADC—converter with an input operationally connected to the output of the AEC and with an output, a digital-to-analog—DAC—converter with an output operationally connected to the input of the EAC, a difference forming unit with a first and with a second input and with an output, the first input being operationally connected to the output of the ADC, an amplifier filter unit with an input and with an output, the input being operationally connected to the output of the difference forming unit, the output being operationally connected to the input of the DAC, an adaptive compensator filter unit with an input and with an output and with an adaption control input, the input being operationally connected to the output of the amplifier filter unit, the output being operationally connected to the second input of the difference forming unit, the adaption control input being operationally connected to the output of the difference forming unit, a first transform unit with an input and with an output being operationally interconnected between the adaption control input and the output of the difference forming unit, a second transform unit with an input and with an output being operationally interconnected between the input of the adaptive compensator filter unit and the output of the difference forming unit, an inverse transform unit with an input and with an output operationally interconnected between the output of the adaptive compensator filter unit and the second input of the difference forming unit, the first and second transform units performing a fast orthogonal transformation on time domain input signals to generate frequency domain output signals, the inverse transform unit performing a transform inverse to that of the transform units.

By the fact that the time domain to frequency domain transform is not anymore, as shown in FIG. 2, performed at the input side of the difference forming unit $13_f$, but the difference at this unit is formed still in the time domain, the required time invariance of the system may astonishingly be established. Especially when selecting suitably lapped block separation, it becomes possible to realize the time domain to frequency domain transforms with significantly smaller block lengths, which consequently improves efficiency of the compensation filter action. This further allows to rise the gain at the amplifier filter unit $5_f$ drastically compared with the system of FIG. 2.

Other objects, advantages and preferred features of the inventive hearing aid apparatus will become evident to the man skilled in this art when reading the description and the claims of the present application.

BRIEF DESCRIPTION OF THE DRAWINGS

The present invention, under all its aspects, will be better understood and objects other than those set forth above will become apparent to the man Skilled in this art when consideration is given to the following detailed description thereof.

Such description makes reference to the annexed drawings, wherein:

FIG. 5 shows a further preferred embodiment of the inventive hearing aid apparatus in a representation in analogy to that of the FIGS. 1 to 4 which hearing aid apparatus is an improvement of that shown in FIG. 4;

FIG. 6 shows by means of a simplified signal flow/functional block diagram a preferred realization form of a transform unit which is provided at the adaption control input and at the input of the amplification filter unit as realized at the embodiment of FIG. 5;

FIG. 7 shows by means of a simplified signal flow/functional block diagram a preferred embodiment of the amplification filter unit at an inventive hearing aid apparatus according to FIG. 5;

DESCRIPTION OF PREFERRED EMBODIMENTS OF THE INVENTION

Figure 1:
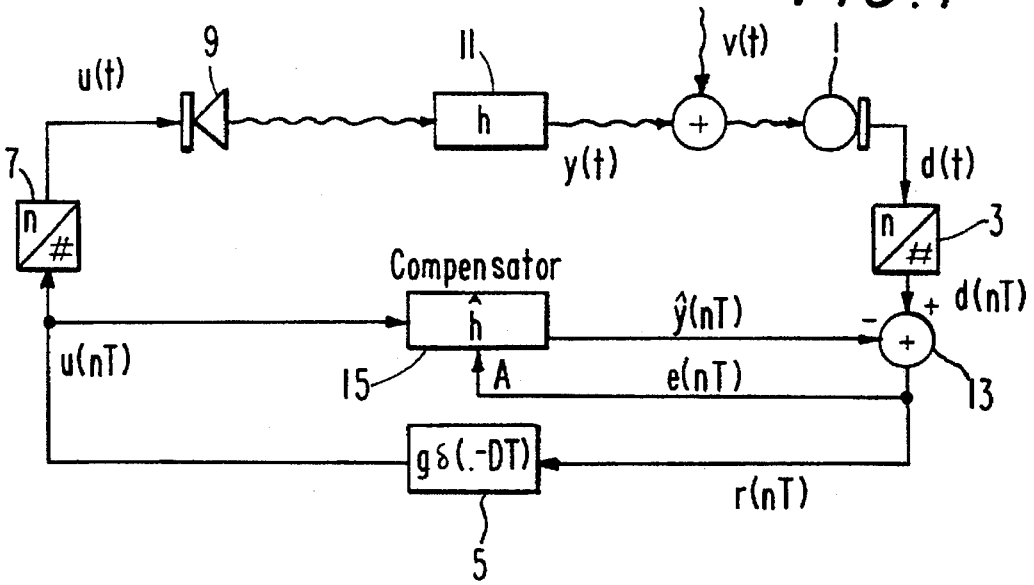
FIG. 1 shows a simplified functional block diagram of a prior art hearing aid apparatus at which signal treatment occurs in the time domain.
Figure 2:
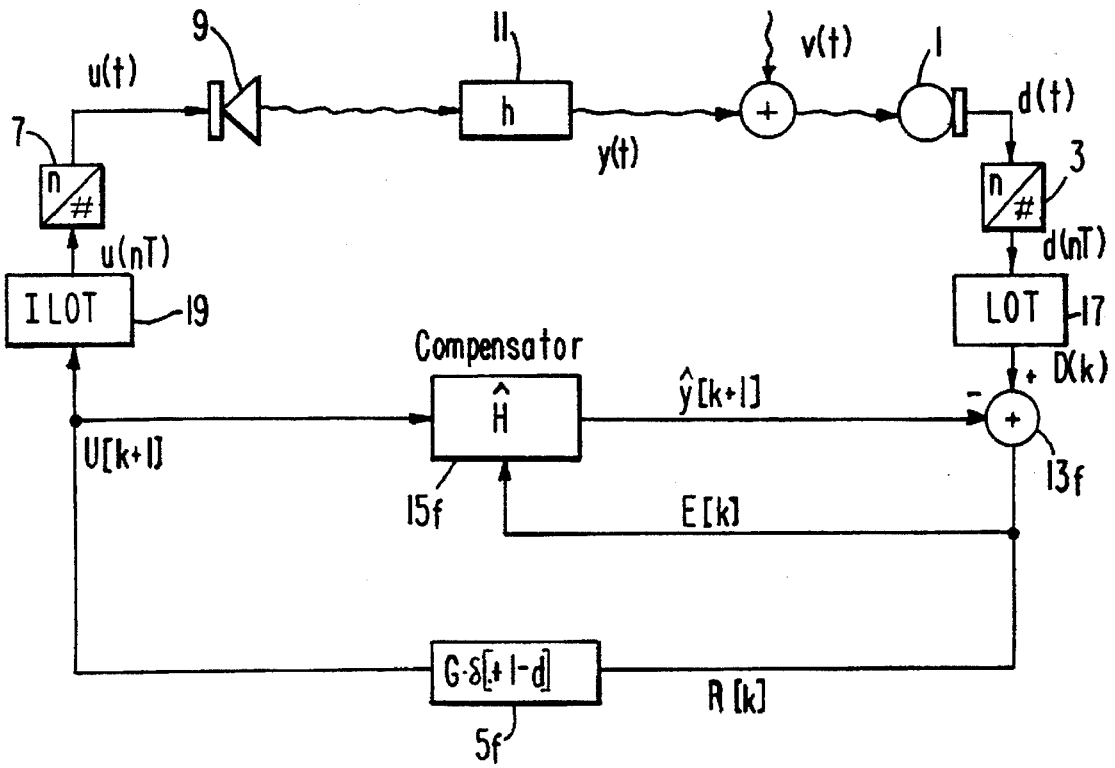
FIG. 2 shows in a representation in analogy to that of FIG. 1, a further prior art hearing aid apparatus at which signal treatment occurs in the frequency domain at a feedback compensator and at an amplification filter according to FIG. 1.
Figure 3:
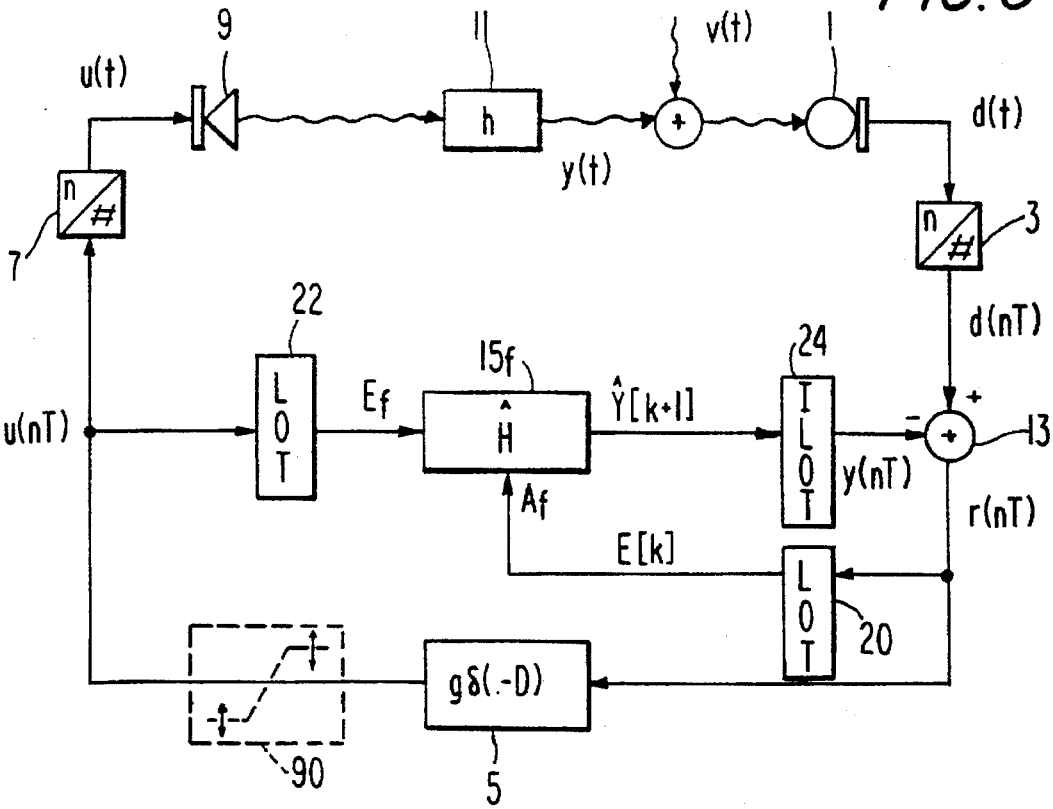
FIG. 3 shows in analogy to FIGS. 1 and 2 a first embodiment of a hearing aid apparatus according to the present invention.

FIG. 3 shows by means of a signal flow/functional block diagram a principle of the present invention under a first aspect. The reference numbers, which were already used in FIGS. 1 and 2 for functional blocks and signals, are also used in FIG. 3 to facilitate cross reference.

Figure 4:
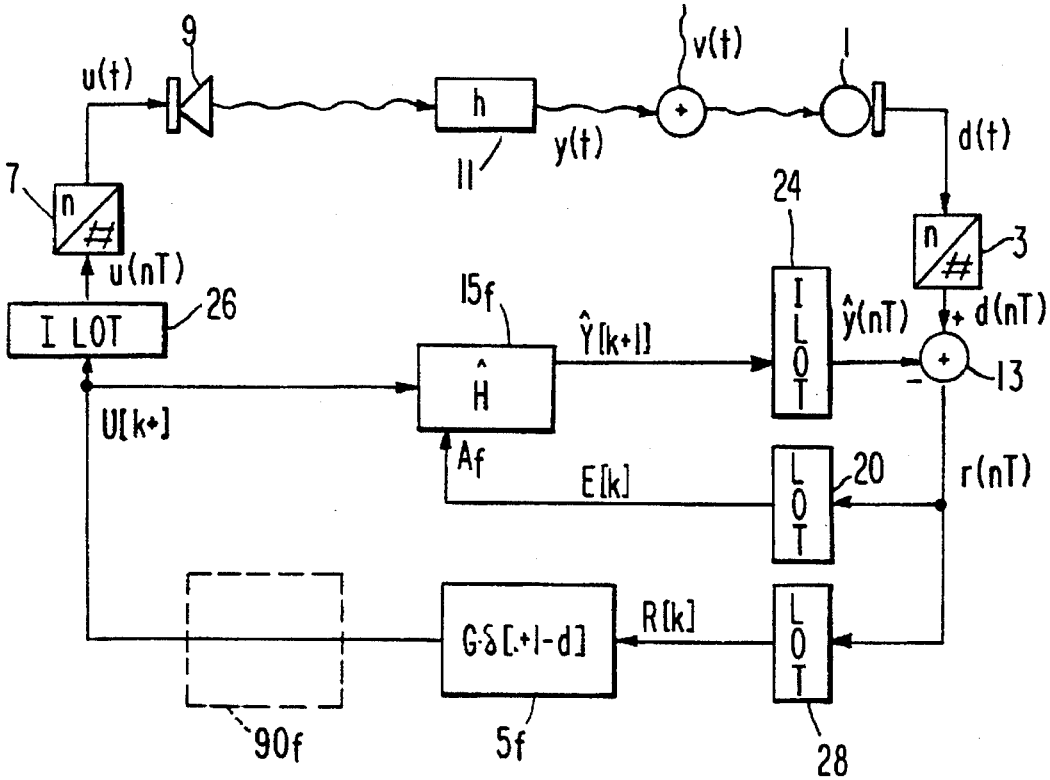
FIG. 4 shows a further preferred embodiment of the inventive hearing aid apparatus, based on that of FIG. 3, and shown in an analog representation as FIGS. 1 to 3.

In the embodiments of the inventive apparatus according to both FIGS. 3 and 4, the time discrete difference signal r(nT) is formed at the difference forming unit 13 from the digitalized output signal d(t) of the AEC 1 and from the output signal of the adaptive compensation filter unit $15_f$. It is the time discrete difference signal r(nT) at the output of the difference forming unit 13 which is subjected to an overlapping orthogonal transform LOT.

According to FIG. 3, the difference signal r(nT) is transformed by a LOT transform unit 20 in the adaption control signal E[k] which is led to the adaption control input $A_f$ of the adaptive compensator filter unit $15_f$. Because the time domain to frequency domain transform occurs at the LOT-transform unit 20 with data blocks with a predetermined number of samples from the difference signal r(nT), the feature [k] defines the number of a signal block at the output of the transform unit 20.

The difference signal r(nT) is fed according to FIG. 3 in time domain to the amplification filter unit 5, the output thereof being operationally connected to the EAC 9 via the DAC 7. At the input, the DAC 7 receives the time discrete output signal u(nT) from the amplification filter unit 5. This output signal u(nT) is subjected to a further orthogonal transform at the transform unit 22, where it is transformed from time domain into frequency domain. The output signal of the transform unit 22 is fed to the signal input $E_f$ of the adaptive compensator filter unit $15_f$. The output signal Y[k+1] of the adaptive compensation filter unit $15_f$ is inverse transformed at an inverse transform unit ILOT 24 from frequency domain back into time domain. The output signal y(nT) of the inverse transform unit 24 is led, as a time discrete signal, to the difference forming unit 13.

Additionally to the embodiment according to FIG. 3 and now according to FIG. 4, not only signal treatment at the adaptive compensation filter unit $15_f$ is performed in the frequency domain, but also signal treatment at the amplification filter unit $5_f$. Thereby a transform unit LOT 28 is provided, the frequency domain output thereof being operationally connected to the input of the amplification filter unit $5_f$. An inverse transform unit ILOT 26 is operationally connected with its output to the input of the DAC 7. Compared with the embodiment of FIG. 3, the embodiment of FIG. 4 has no transform unit 22.

Principally, and as was shown at the embodiments of the FIGS. 3 and 4, the main difference to prior art embodiments according to FIG. 2 is that difference formation at the difference forming unit 13 inventively occurs in the time domain whereby the above mentioned drawbacks of prior art embodiments with respect to time variance become remedied.

Thereby, it becomes possible to deal with drastically reduced block lengths at the LOT transform units 20, 22, 28 and accordingly at the inverse transform units 24 and 26 compared with the prior art approach according to FIG. 2. In a preferred embodiment of the present invention, the block length of the blocks numbered k is 128 samples.

FIG. 3 further shows an embodiment in which one transform unit LOT 20 and one transform unit LOT 22 are respectively provided at the input $E_f$ of the adaptive compensation filter unit $15_f$ and at its adaption control input $A_f$.

A preferred embodiment is nevertheless that according to FIG. 4, in which a transform unit LOT 20 is provided for the adaption control input $A_f$ and a transform unit LOT 28 is provided with its output operationally connected to the input of the amplification filter unit $5_f$. Thereby an inverse transform unit ILOT 26 is operationally connected with its output to the DAC 7.

It is known that for the formation and the treatment of data blocks in overlapping orthogonal transforms principally two simple techniques are available, namely that of "overlap-save" and that of "overlap-add". With respect to these techniques, reference is made to the respective literature as e.g. to "Signal processing with lapped transforms", Henrike S. Malvar, Artec House, Boston, 1992.

In a preferred embodiment of the present invention, and as shown in FIG. 4, a LOT transform unit 28 is also provided at the input of the amplification filter unit $5_f$, an inverse transform unit 26 is provided at the input of the DAC 7 and a further ILOT inverse transform unit 24 is provided at the output of the adaptive compensation filter unit $15_f$.

These transform and inverse transform units 38, 24, 26 operate in a preferred embodiment according to the "overlap-save" technique. Thereby, and in this preferred embodiment, the LOT transform unit 20 provided at the adaption control input $A_f$, according to FIG. 4, operates according to the "overlap-add" technique.

This last mentioned preferred embodiment and block treatment lead to a further preferred embodiment of the inventive hearing aid apparatus, which is shown in FIG. 5.

In opposition to the embodiment of FIG. 4, the time discrete difference signal r(nT) is here operatively connected to a single LOT transform unit 30 from the output signal of which the adaption control signal E[k] fed to the adaption control input $A_f$ as well as the input signal R[k] fed to the input of the amplification filter unit $5_f$ are derived.

As was mentioned, the overlapping orthogonal transform preferably bases on DFT.

FIG. 6 shows a realization form of a data transfer path of the time discrete difference signal r(nT) at the output of the difference forming unit 13 to the adaption control input $A_f$ as the adaption control signal E[k] and further to the input of the amplification control unit $5_f$, as input signal R[k] according to FIG. 5.

According to FIG. 6, the output of the difference forming unit 13 with the time discrete difference signal r(nT) is operationally connected to the input of an overlap orthogonal transform unit 30*a*, which operates on the basis of DFT. The transform unit 30*a* operates according to "overlap-add" technique as is marked in FIG. 6 by the "OA" index. Thereby at the input of the transform unit 30*a*, the error block e[k] is formed by dividing r(nT) into partial blocks with a length N. In a preferred embodiment the length is N=64. These blocks are lengthened to an overall length of 2N by hulling, thus, in the preferred embodiment, to the length of 2N=128. This means:

$$e[k]=(0\ldots 0, r((k+1)NT), r((k+1)NT+T)\ldots r((k+2)NT-T))^T.$$

Its DFT, i.e. the signal E[k], is fed, according to a preferred embodiment according to FIG. 5, directly to the adaption control input $A_f$ of the adaptive compensation filter unit $15_f$. Via a time-lag unit 32, wherein a respective buffering occurs, subsequent data blocks, i.e. with the numbers k and k+1, are prepared. A superposition of the blocks, block partition by block partition, results directly in a block R[k], now of the "overlap-save" type, which is directly led to the input of the amplification filter unit $5_f$, as was previously mentioned as preferred technique, according to FIG. 5. The superposition at the unit 34 is thereby defined by $$R_j[k]=E_j[k]+(-1)^j E_j[k-1],$$

wherein j (running from 0 to 2N−1) designates the number of the respective block partition.

By this realization a substantive reduction of hardware and calculation efforts are realized.

According to FIG. 7, the amplification filter unit $5_f$, which received the data blocks R[k], comprises first an amplification filter 40, the output of which being operationally connected to the input of a time-lag unit 42 performing according buffering. Thereby, the parameter d designates the overall time-lag of the system considered from the output of the ADC 3 to the input of the DAC 7 and normalized with the overlap parameter of the partial block length N. Due to this block treatment, there results a minimal time-lag of N samples according to a minimal d-value of 1. In the preferred embodiment with a partial block length of N=64 and with an overall block length of 2N=128, d was set on a value of 2, thereby making use of a single partial compensator as will be explained with reference to FIG. 8.

The block signal U[k+1] at the output of the time-lag unit 42 and of the amplification filter unit $5_f$ is operatively connected on one hand to the input $E_f$ of the adaptive compensator filter unit $15_f$ and on the other hand to the input of the ILOT inverse transform unit 26, where it is subjected to an inverse DFT transform in "overlap-save" technique. Because the resulting time signal u(nT) is generated with a time-lag according to a partial block length N, the block numbering k+1 of the signal U[k+1] is justified.

Figure 8:
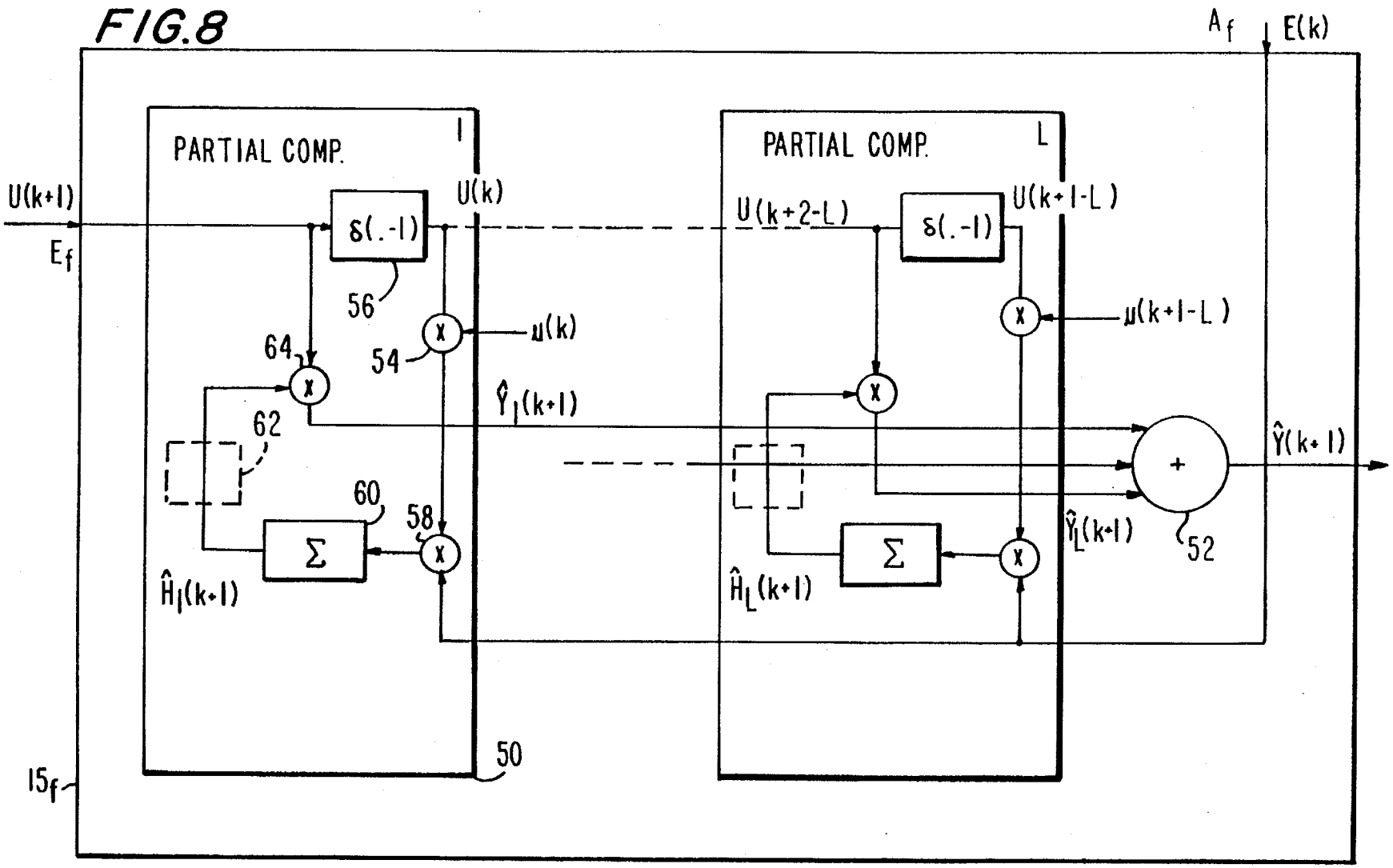
FIG. 8 shows a simplified signal flow/functional block diagram of a preferred realization of an adaptive compensation filter unit at the inventive hearing aid apparatus according to FIG. 5.

In FIG. 8 a preferred embodiment of the adaptive compensation filter unit $15_f$ at the inventive hearing aid apparatus according to FIG. 5 is shown. Thereby, block signals U[k+1] to U[k+1−L] are prepared by buffering with time-lag units of the type as shown at 56. Therefrom, and with the help of partial compensators, the first of which being defined by the reference number 50, partial estimate signals $Y_1$[k+1] to $Y_L$[k+1] are generated, which partial estimate signals are added at an addition unit 52 to result in the overall estimate signal Y[k+1]. As shown in FIG. 5, there occurs subsequently in the ILOT inverse transform unit 24 the inverse transform back into time domain, in the preferred embodiment by means of an inverse DFT transform of "overlap-save" type.

With reference to the first partial compensator, the partial estimate signal $Y_1$[k+1] appears at the output of the multiplication unit 64, whereby the block signals U[k+1] and the block weighing signal $H_1$[k+1] are applied to the inputs of the multiplication unit 64. The multiplication is thereby performed for each block partition according to the formula $$Y_{i,j}[k+1]=U_j[k+2-i]H_{i,j}[k+1],$$

wherein j designates the block partition from 0 to 2N−1 and i designates the number of the partial compensator considered, from 1 to L.

The block weighing $H_i$[k+1] represents thereby the actual estimate in the frequency domain for the partition i of the length N of the time discrete pulse response h of the acoustical-mechanical disturbance feedback 11. The estimate $H_i$[k+1] is actualized on the basis of the former estimate $H_i$[k] previous to the formation of $Y_{i,j}$[k+1]. To do so, and again with reference to the first partial compensator, the block signal U[k+1−1] and the step width μ[k+1−1] are fed to the multiplication unit 54, the output signal of which being fed to the multiplication unit 58 together with the block signal E[k]. The output of multiplication unit 58 is then used for actualizing $H_1$[k+1] in the summation unit 60, according to formula $$\overline{H}_{i,j}[k+1]=\overline{H}_{i,j}[k]+\mu_j[k+1-i]U_j^*[k+1-i]E_j[k].$$

The index (*) stands for "conjugate complex number", j designates again the block partition and i the partial compensator.

A realization by means of partial compensators has the advantage that the minimal time-lag D=N may be adjusted independently from the length of the pulse response of the disturbance feedback 11 by appropriate selection of the partial block length N. Thereby, a "trade-off" between time-lag D and the partial block length N, which determines the efficiency of operation, becomes possible. Further, specific parts of the pulse response h may be specifically influenced by according block weighing in the frequency domain, e.g. according to the acoustical low- and long-distance parts.

Principally, each known method may be used for governing the step width μ[k].

Figure 9:
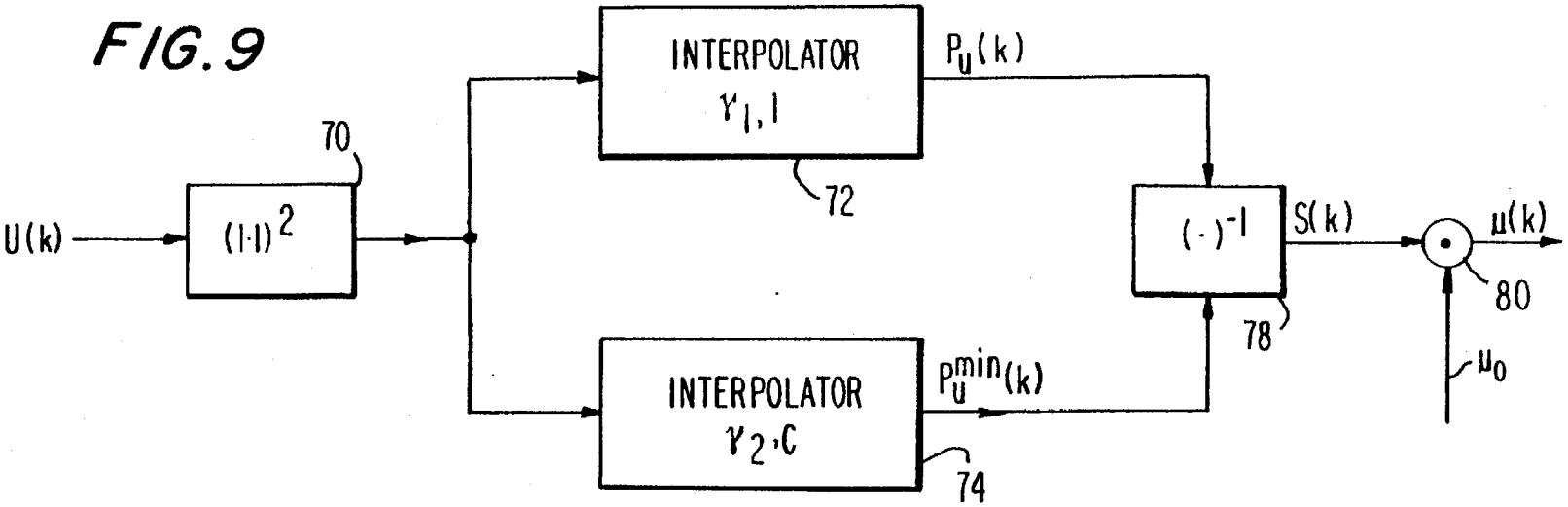
FIG. 9 shows by means of a simplified signal flow/functional block diagram the generation of a step width signal as a function of monitored signal power, whereby the step width signal, as formed preferably as shown in FIG. 9, is applied to the adaptive compensation filter unit according to FIG. 8.

In FIG. 9 an embodiment preferred today is shown for generating the normalized step width μ[k] according to FIG. 8, which may additionally be used for disabling the adaption procedure. Thereby, and e.g. departing from the block signal U[k] according to FIG. 8, this block signal is used to calculate the actual block signal μ[k] before it is applied to the multiplication unit 54. This is done in that the block signal U[k] is led to a signal-power determining unit 70 which acts with its output onto two interpolation filters 72 and 74. The interpolation filters 72 and 74 control with their outputs the scaling unit 78, which generates the scaling value S[k] led to the input of the multiplication unit 80. The scaling value S[k] is used for normalizing the reference step width $\mu_0$.

The interpolation filters operate according to the formula $$P_{U,j}[k]=c(1-\gamma)U_j^*[k]U_j[k]+\gamma P_{U,j}[k-1]$$

and are parametrisized with $\gamma$ and c. The index j stands for the block partition. In the preferred realization form $\gamma$ was selected to be 0.8 and c=1 for filter 72 and $\gamma$=0.995 and c=0.2 for the filter 74.

If for the interpolator filter 74 $\gamma$ is selected to be 1, then this interpolator filter is void and it remains a block signal $P_U^{min}$ which is constant in time and which may suffice in some cases, further reducing hardware and calculation efforts.

The scaling value S[k] is on one hand used for normalizing the reference step width $\mu_0$ via the output of the filter 72 which is referred to in FIG. 9 by the block signal $P_U[k]$. On the other hand, the scaling value S[k] is used to freeze or disable the adaption procedure of specific frequency components via the output of the filter 74 which is designated in FIG. 9 as block signal $P_U^{min}[k]$, if efficiency is not satisfying. Thereby the scaling value S[k] is formed according to formula $$S_i[k] = \begin{cases} 0 & \text{for } P_{Uj}[k] < P_{Uj}^{min}[k] \\ P_{Uj}^{-1}[k] & \text{otherwise} \end{cases},$$

whereby the j again designate the block partition.

Figure 10:
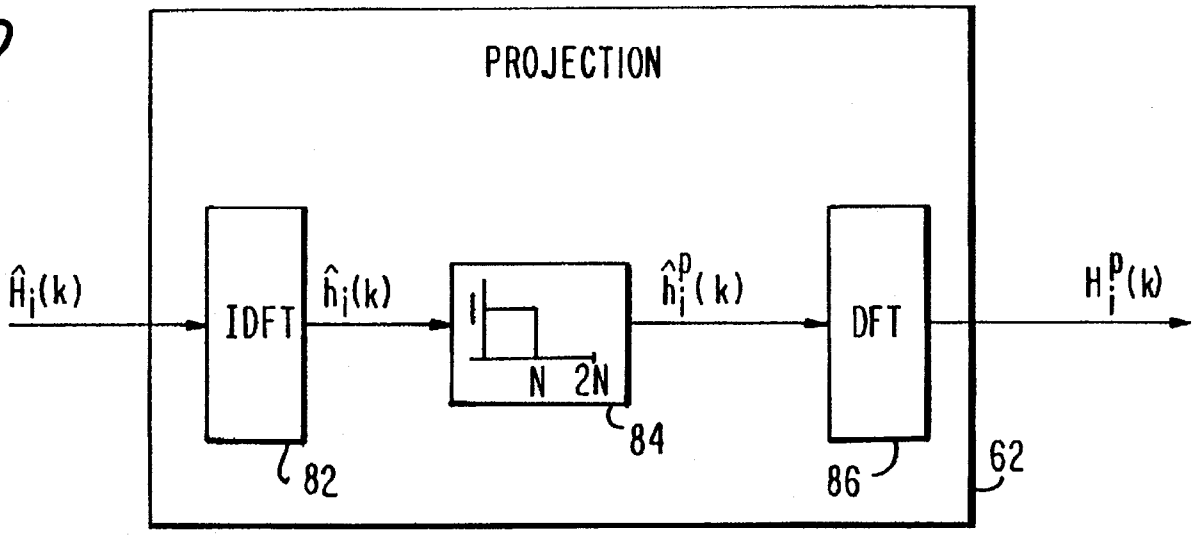
FIG. 10 shows by means of a simplified signal flow/functional block diagram a unit which is preferably implemented when realizing the adaptive compensation filter unit as shown in FIG. 8.

In FIG. 10 there is shown a further preferred embodiment which significantly improves the speech quality when partial compensators according to FIG. 8 are used and at unchanged further parameters. Thereby the estimate $H_i[k+1]$ of the partial compensator i is led previously to multiplication with U[k+2−i] at the multiplication unit 64 of FIG. 8 to a projection unit 62. E.g. the block weight $H_i[k+1]$ is thereby subjected to an inverse DFT transform at unit 82 and is then cleaned, by nulling all block partitions with the indexes N to 2N−1 at the unit 84. Finally, the output signal of unit 84 is back-transformed into the frequency domain by the DFT unit 86.

As is known, the EAC 9 is not linear in the sense that it does not anymore linearly transform the input signal into an output signal if the input signal is larger than a predetermined input signal level. Besides the acoustical distortions which are caused by such behaviour, it must be considered that the signal transmission path via the adaptive compensation filter unit $\mathbf{15}_f$ should be adapted as exactly as possible to the signal path via the functional blocks 7, 9, 11, 1 and 3. The adaptive compensation filter unit as described up to now may not take into account such non-linearities. Additionally, the maximum acoustical output level of the hearing aid apparatus should be adjustable according to individual needs of the users, Thereby the problem that the converter 9 could be driven in its non-linear operating range does obviously only occur if the individually adjusted maximum output level my still drive the converter 9 in the said non-linear operating range.

Based on these considerations and in a further preferred embodiment, also under a more general separate aspect of the present invention and as shown in dashed lines in FIG. 3, a limiter unit 90 operating in the time domain in the specific embodiment according to FIG. 3 is provided at the output of the amplification filter unit 5. This limiter unit 90 limits the output signal amplitude from the amplification filter unit 5, so that the EAC converter 9 is never driven in its non-linear operating range. Additionally, the limiting unit 90 enables to individually set the maximum output level of the acoustic signal at EAC 9 as is schematically shown with the double arrows in block 90.

At the embodiment according to FIG. 4, the aspect of individual maximum power setting and of not linear operation of EAC 9 are considered by providing at the output of the amplifier filter unit $\mathbf{5}_f$, which operates in the frequency domain, a unit $\mathbf{90}_f$, which, in the frequency domain, limits the frequency components of the signal spectrum considering their respective phasing, so that at the output of the inverse transform unit 26 and of the DAC 7 a time varying signal u(t) is formed which never drives the EAC 9 into its not linear operating range. Unit $\mathbf{90}_f$ additionally allows to set or adjust individually a maximum output level for the EAC 9.

The same technique is realized with the unit $\mathbf{90}_f$ at the embodiment of the invention according to FIG. 5.

Figure 11:
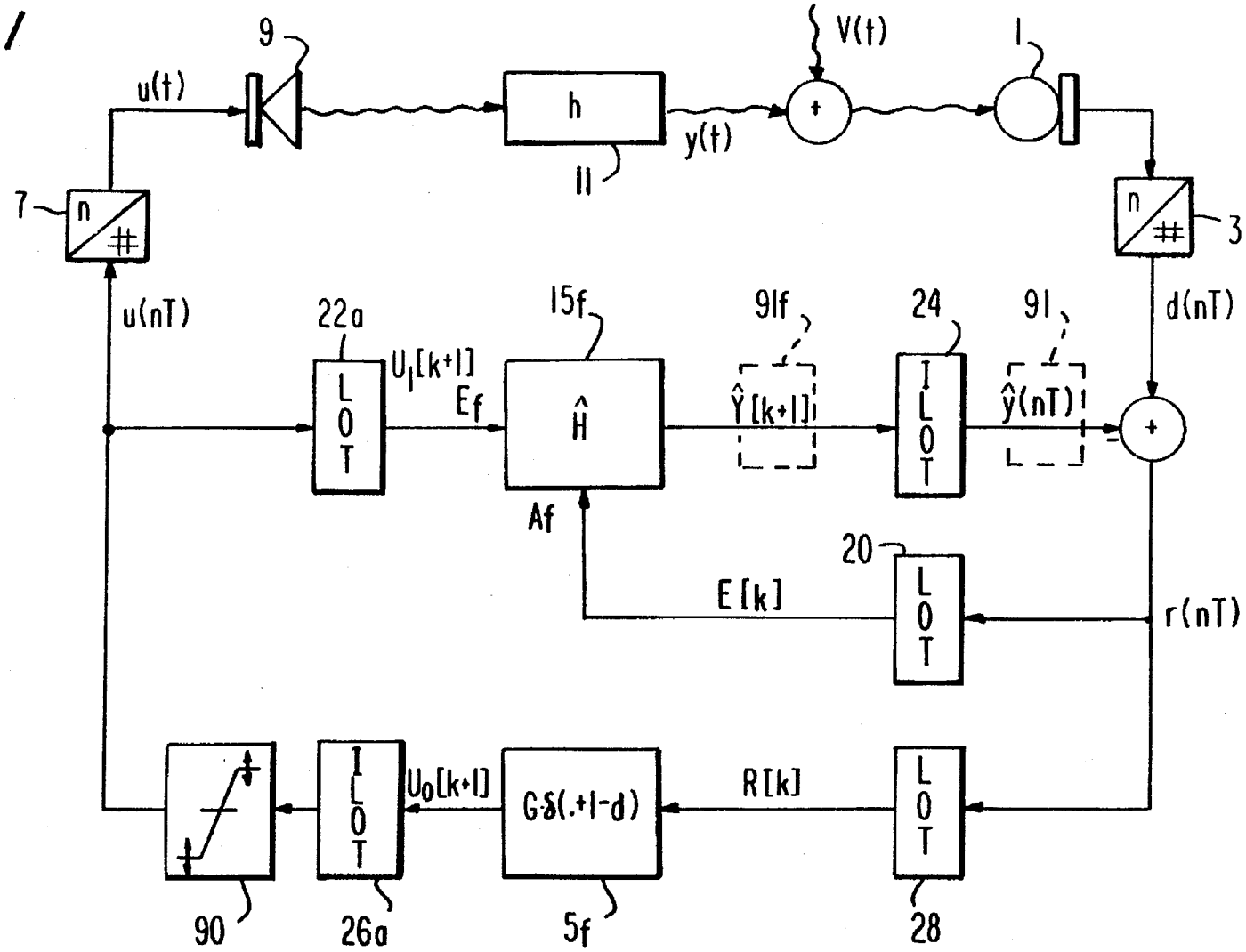
FIG. 11 shows, departing from an inventive hearing aid apparatus as shown in FIG. 4, an embodiment as today preferred, shown in functional block diagram representation.

FIG. 11 shows a further preferred embodiment of the inventive hearing aid apparatus which generally accords with the embodiment according to FIG. 4 with the difference that the inverse transform unit 26 according to FIG. 4 appears, according to FIG. 11, as unit **26*a* directly at the output of the amplification filter unit $\mathbf{5}_f$. At the input of the adaptive compensation filter unit $\mathbf{15}_f$, there is provided a LOT transform unit 22*a* as was discussed above. In spite of the fact that the embodiment of FIG. 11 does not seem to be of any advantage compared with the embodiment of FIG. 4, the embodiment of FIG. 11** allows to realize options which are discussed below.

As may be seen from FIG. 4, which shows, as does FIG. 5, a preferred embodiment of the inventive hearing aid apparatus, provision of a limiter unit is only possible in the frequency domain because such a limiter unit must be effective in the feedback compensation signal path with the adaptive compensation filter unit $\mathbf{15}_f$ too.

As now may be seen from FIG. 11, the functional block structure here allows to provide the limiter unit 90 operating in the time domain which leads to a limiter unit 90 which is significantly simpler to realize compared with a limiter unit operating in the frequency domain.

This also allows introduction of further improvements by units for compensating not linear effects as described in the following.

For ensuring an accurate identification of the EAC 9 by the adaptive compensation filter unit $\mathbf{15}_f$, first the input level to the EAC 9 is limited to prevent that this converter 9 is operated in its not linear saturation range. This leads to a reduction of the maximum possible gain of the inventive hearing aid apparatus between AEC 1 and EAC 9.

Figure 12:
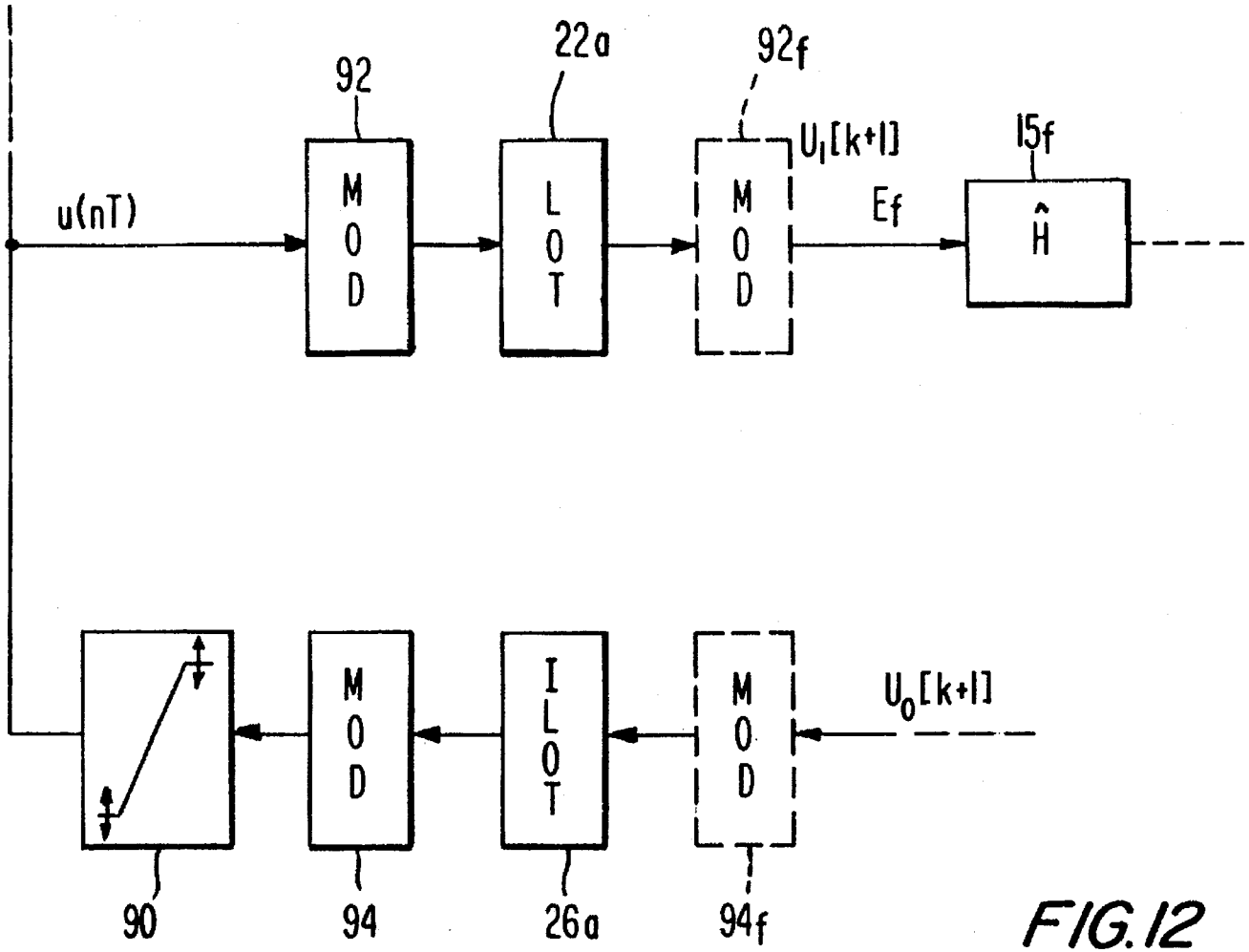
FIG. 12 shows a part of an improved embodiment of the inventive hearing aid apparatus according to FIG. 11 with modelling of the EAC in the time domain and/or in the frequency domain.

In FIG. 12 a preferred embodiment of signal treatment at the input side of the adaptive compensation filter $\mathbf{15}_f$ and at the output side of the amplification filter $\mathbf{5}_f$ is shown for an improved embodiment principally according to the apparatus according to FIG. 11.

According to FIG. 12 the EAC 9 with its non-linearities is modelled principally in the signal path with the adaptive compensation filter unit $\mathbf{15}_f$. This is realized by a modelling unit 92 at the input of the transform unit **22*a* according to FIG. 11, which modelling unit 92 thus operates in the time domain. Additionally or alternatively, a modelling unit $\mathbf{92}_f$ may be provided at the output side of the transform unit 22*a***, which thus operates in the frequency domain.

By this realization it is reached that, depending on the accuracy of the modelling unit 92, the limit set at the unit 90, and thus the limit for its output signal, may be risen by approximately 6 dB compared with the embodiment according to FIG. 11. Thereby, it is also possible to omit unit 90.

The modelling unit 92 may be e.g. realized as described in R. Isermann, "Identifikation dynamischer Systeme" (Identification of dynamic systems), Springer Verlag, 2:238, 1988, as a simplified Wiener-Model.

The transform into time domain between amplification filter unit $\mathbf{5}_f$ and adaptive compensation filter unit $\mathbf{15}_f$ allows, additionally and as was described before, the addition of a not linear correction filter into the signal path with the amplification filter unit $5_f$.

This may be realized, as shown in FIG. 12, by means of a modelling unit 94 at the output of the inverse transform unit 26a and thus operating in the time domain and/or by a modelling unit $94_f$ at the input of the inverse transform unit 26a and thus operating in the frequency domain.

It is clearly possible to replace the LOT transform units 20 and 28 of the embodiments of FIGS. 11 and 12 by a single LOT transform unit 30 as shown in the FIGS. 5 and 6.

Figure 13:
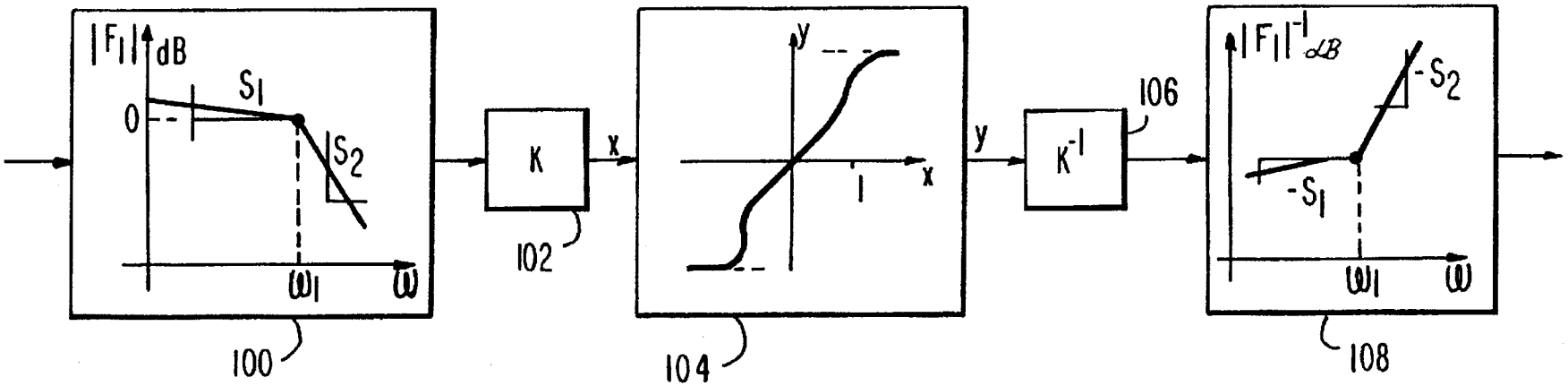
FIG. 13 shows a functional block/signal flow diagram of an electrical modelling unit, modelling the behaviour of a loudspeaker in time domain and as it is preferably implemented at the inventive hearing aid apparatus according to one of the FIGS. 3, 11 or 12 for modelling transfer behaviour of the EAC of the hearing aid apparatus.

In FIG. 13 the realization of a modelling unit modelling the behaviour of a loudspeaker and thus of EAC 9 is shown, operating in the time domain. Such modelling unit is considered per se as inventive. Especially with the hearing aid apparatus according to the present invention and according to FIGS. 3 and 11 such a modelling unit is used as block 90 and, according to FIG. 12, instead of the blocks 92, 90, 94 respectively.

The modelling unit comprises a prefilter 100 with a transfer characteristic $F_1(\omega)$ being substantially a low path characteristic. The corner frequency $\omega_1$ of the Bode diagram schematically shown in prefilter block 100 is approximately 0.8 kHz in a preferred embodiment, the gain $|F_1|$ at this corner frequency $\omega_1$ approximately 0 dB. The slope $S_1$ is approximately 0 dB/DK.

The identification entities, namely corner frequency $\omega_1$ and the slopes $S_1$ and $S_2$ as well as the gain, e.g. at the corner frequency $\omega_1$, are found by identification of the loudspeaker or EAC 9 to be modelled.

Following the prefilter 100, there is provided a linear amplification unit 102 at which the amplification factor K is set. Following the linear amplification unit 102, there is provided a not-linear amplification unit 104. The transfer characteristic of the not-linear amplification function Y=Q (x) is e.g.:

$$y=x+ax^2+bx^3+cx^4+dx^5.$$

For small input signals, the amplification of the not-linear amplification unit 104 is unity, so that the amplification characteristic adjacent to the origin has the slope 1. For larger input signals x the not linear amplification characteristic has, as is known from loudspeakers or from EAC 9, saturation characteristic.

The coefficients a, b, c, d of the not-linear amplification characteristic and the amplification factor K are determined by identifying the converter to be modelled.

Following the not-linear amplification unit 104, there is provided a linear amplification unit 106, whereat the amplification K of the linear amplification unit 102 is compensated, $K^{-1}$. Following the unit 106, there is provided a filter unit 108 substantially with high pass characteristic, which, as is shown in FIG. 13, substantially compensates the frequency characteristic of the prefilter 100.

Thus, the converter modelling unit, i.e. the loud speaker or EAC 9 modelling unit as shown in FIG. 13, comprises substantially a linear amplification part formed by the units 100, 102, 106, 108 and a not-linear amplifier unit 104.

Saturation and thus limiting phenomena may have, besides the two origins mentioned—namely wanted limitation of the maximum output level of EAC 9, according to individual need, or driving EAC 9 into its converter specific, not-linear saturation area—a third reason: It may be caused by a drop of battery voltage which supplies the inventive apparatus. Ageing of the battery which supplies the hearing aid apparatus leads especially at the DAC 7 to a decrease of signal gain and thus to a decrease of full-scale analog output signal.

Additionally, the output impedance of the battery appears normally in series to the impedance of the EAC 9. Thus, with increased ageing of the battery, the increasing battery output impedance, which appears in series to the EAC 9, leads to an impedance at the output side of DAC 7 which varies in time. This affects the non-linearities at the output side of DAC 7 to be modelled as discussed above.

With the object of maintaining a high accuracy of the compensation of the disturbance feedback, as is the main object of the present invention, and to maintain stability of that compensation, the limiting unit 90, according to the FIGS. 3 or 4, operating in time domain, or $90_f$, operating in the frequency domain, according to FIG. B, is controlled by the instantaneous battery output voltage and/or the intantaneous battery output impedance.

Figure 14:
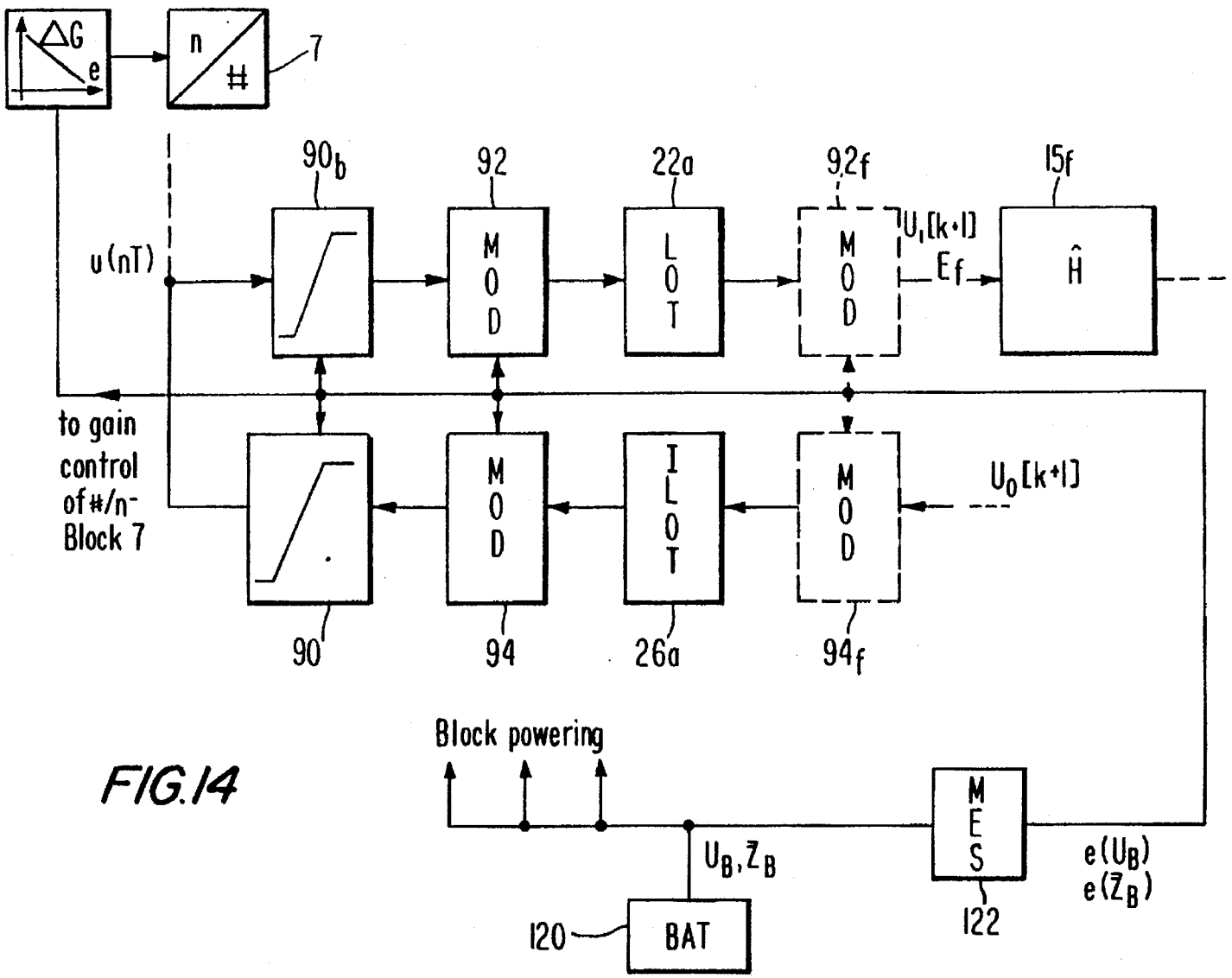
FIG. 14 shows, departing from the embodiment of FIG. 12, a further improvement of a part of the inventive hearing aid apparatus at which modelling and/or amplitude limitation and/or the gain are controlled in function of the instantaneous conditions of a battery feeding the inventive apparatus.

Departing from the embodiment of FIGS. 11 and 12, such battery state control is schematically shown in FIG. 14. At the output of the battery unit 120 which, as schematically indicated by "block powering", electrically supplies the electronic active components of the functional blocks as described of the inventive hearing aid apparatus, there is provided a monitoring unit 122 which monitors the instantaneous battery output voltage $U_B$ and/or the instantaneous battery output impedance $Z_B$. There result accordingly measuring signals $e(U_B)$ and/or $e(Z_B)$. These measuring signals control the limiting unit 90 and, analogically in the frequency domain, the limiting unit $90_f$ according to FIGS. 3, 4, 5, 11, 12 and 14, and/or the modelling units 92, $92_f$ or, respectively, 94, $94_f$ of FIGS. 12, 13, 14.

Preferably the measuring signals e are digitalized in that the monitoring unit 122 is operationally connected with an ADC (not shown in FIG. 14).

By the instantaneous battery output voltage and/or output impedance, especially the limits of the limiting units and/or the parameters of the modelling units are adjusted, thereby taking into account the instantaneous battery state.

The parameters of modelling at the modelling units 92, $92_f$ or 94, $94_f$ are adjusted in that they are changed by calculation as a function of the said battery state or in that different sets of such parameters are stored and are enabled by and according to the instantaneous battery state.

As further shown in FIG. 14, a decrease of gain at the DAC 7 due to a drop of the battery output voltage may be compensated as a function of the measuring signal e: If the battery voltage drops and thereby the gain at the DAC 7, the measuring signal e controls the gain at block 7 to be compensatorily increased. The battery voltage drop additionally acts like a signal limitation by a limiter and is preferably considered by means of a limiter unit $90_b$ at the input side of the modelling block 92 or $92_f$ according to FIG. 14, which limiter unit $90_b$ is controlled by the instantaneous battery output voltage.

If a limiter unit $90_b$ according to FIG. 14 is provided, the units 90 may be omitted. If modelling unit 92 or $92_f$ are provided, the units 94 or $94_f$ may be omitted so that a relatively simple feedback compensation is reached, which is independent of the instantaneous battery voltage.

On the ocher hand, the function of the unit $90_b$ may completely be replaced by units 90 or $90_f$ according to FIGS. 4 or 5, which are controlled as a function of battery output voltage.

Taking the battery voltage drop into account with respect to signal limitation by means of limiter units as 90, $90_f$ or $90_b$ is of high importance for ensuring stability of the hearing aid apparatus as the battery voltage varies significantly.

For maintaining stability of feedback compensation, even in very loud surroundings, where, e.g. according to FIG. 11, the AEC 1 could be saturated and thus would become not linear, there is provided, if necessary, a not linear model of the AEC 1, which, if necessary, also models the behaviour of the ADC 3. Such modelling unit is provided between the output of the adaptive compensator filter unit 15 of FIG. 1 or $\mathbf{15}_f$, e.g. according to FIG. 11, and the substraction input of the difference unit 13 e.g. according to FIGS. 1 or 11.

According to where such modelling unit is arranged, it operates in the frequency domain or in the time domain, as is shown at 91 or $\mathbf{91}_f$ in FIG. 11. For the modelling unit 91 or $\mathbf{91}_f$ respectively, modelling the behaviour of the AEC 1, the same considerations are valid which were described with respect to modelling the EAC 9 by means of modelling units 92, $\mathbf{92}_f$. Provision of an AEC modelling unit, in fact of a microphone model at a disturbance feedback compensated hearing aid, generally is considered one separate aspect of the present invention. The same is valid for a loudspeaker model as e.g. shown in FIG. 13.

Figure 15:
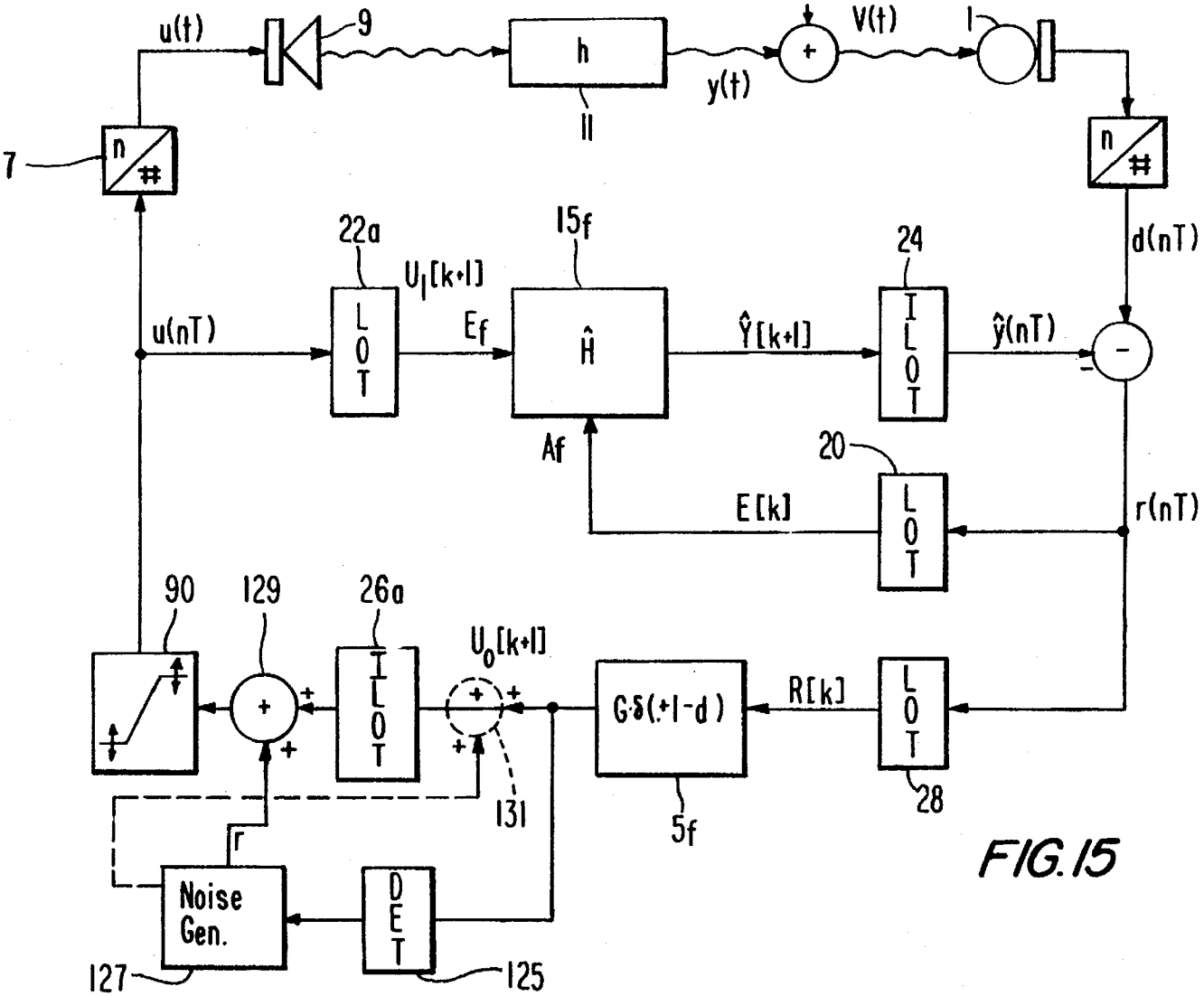
FIG. 15 shows, departing from the embodiment of FIG. 11, a further improvement of the inventive hearing aid apparatus which resides in a controlled appliance of a noise signal in frequency or in time domain and preferably selectively controlled.

A further improvement of effect of the adaptive compensation filter unit $\mathbf{15}_f$ may be reached in that a noise signal in time domain is infed as shown in FIG. 15 at the output side of the amplification filter unit $\mathbf{5}_f$.

This is realized, as shown in FIG. 15, in that a spectrum detector 125 monitors the instantaneous signal spectrum at the output side of the amplification filter unit $\mathbf{5}_f$ and e.g. monitors the significance of power peaks at specific frequency components, i.e. generally power density distribution of the spectrum. If characteristic of the frequency spectrum which is monitored at the unit 125 does not anymore fulfil predetermined conditions, e.g. in that it leaves a predetermined power density distribution, the unit 125 enables the output signal of a noise generator 127 to be superimposed at a superposition unit 129 to the signal at the output side of unit $\mathbf{5}_f$ in the form of digital noise r. To thereby reduce audibility of such noise, a filter unit 133 may be provided at the output of the noise generator 127 as shown in FIG. 16, which filter unit forms the noise so that audibility of the superimposed noise is low enough compared with the audio signal at the output of EAC 9, is e.g. lower by a level of 40 dB.

As is further shown at 131 in dashed lines in FIG. 15, the noise may also be fed to the inventive system in the frequency domain. If noise in time domain is introduced, then the noise generator 127 may e.g. comprise a BPRN. If noise is introduced in the frequency domain according to noise generator 127*a* of FIG. 17, then the noise generator comprises e.g. tables with noise spectra or a noise generating algorithm.

Figure 16:
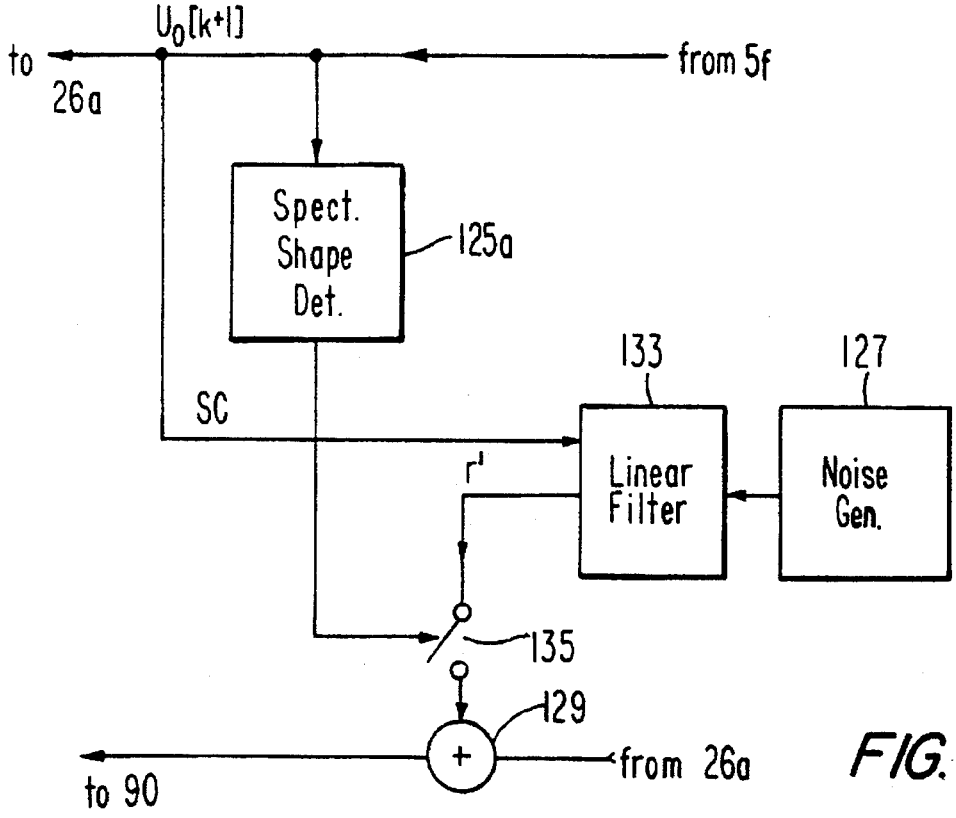
FIG. 16 shows a preferred realization form of noise implementation according to FIG. 15 in the time domain.

FIG. 16 shows, departing from the embodiment of FIG. 15, a preferred realization of noise appliance in the time domain. The output signal of the amplification filter unit $\mathbf{5}_f$ is monitored at a spectrum shape detector unit $\mathbf{125}_a$. If the spectrum shape leaves a predetermined limit characteristic, the output signal of the noise generator 127 is superimposed via a linear filter 133 to the signal u(nT) according to FIG. 15 and, as is schematically shown, with the switching unit 135. The noise is preferably introduced at the input side of the limiter unit 90. As is further shown with a control line sc, the transfer characteristic of the filter 133 is preferably controlled in function of the instantaneous spectrum at the input of the inverse transform unit 26*a*.

Figure 17:
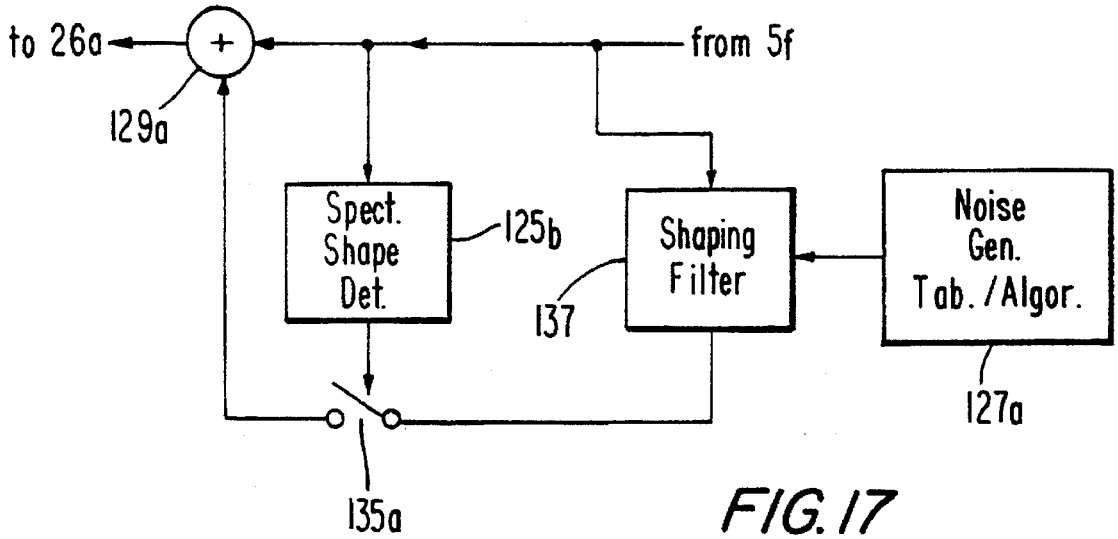
FIG. 17 shows a preferred realization form of noise implementation according to FIG. 15 in the frequency domain.

FIG. 17 shows a preferred realization form of noise appliance in the frequency domain according to the dashed line representation at block 131 of FIG. 15. The spectrum at the output of the amplification filter unit $\mathbf{5}_f$ is again monitored at a spectrum shape detector unit $\mathbf{125}_b$ in analogy to the unit $\mathbf{125}_a$ of FIG. 16. The output signal of a noise generator 127*a*, wherein noise spectra are e.g. stored in tables and are selectively enabled, is superimposed to the spectrum at the output of the amplification filter unit $\mathbf{5}_f$ via a spectrum shaping filter 137 as schematically shown by the switching unit $\mathbf{135}_a$. This occurs whenever the spectrum shape detector unit $\mathbf{125}_b$ detects a spectrum shape which necessitates superposition of noise.

The superposition of the noise signal in the frequency domain occurs at an addition unit $\mathbf{129}_a$. The shaping filter 137 is again controlled by the instantaneous spectrum, e.g. at the output of the amplification filter unit $\mathbf{5}_f$, so as to ensure minimal audibility of the noise coupled into the system.

Principally, introduction of noise controlled by the instantaneous spectrum of the signal transmitted from an AEC to an EAC of a hearing aid apparatus, as concerns its amplitude and/or spectral distribution, is considered a Separate object of the present invention.

We claim:

1. Hearing aid apparatus, comprising:

an acoustical-to-electrical—AEC—converter with an output, an electrical-to-acoustical—EAC—converter with an input, an analog-to-digital—ADC—converter with an input operationally connected to the output of the AEC and with an output, a digital-to-analog—DAC—converter with an output operationally connected to the input of the EAC, a difference forming unit with a first and with a second input and with an output, the first input being operationally connected to the output of the ADC, an amplifier filter unit with an input and with an output, the input being operationally connected to the output of the difference forming unit, the output being operationally connected to the input of the DAC, an adaptive compensator filter unit with an input, an output and an adaption control input, the input being operationally connected to the output of the amplifier filter unit, the output being operationally connected to the second input of the difference forming unit, the adaption control input being operationally connected to the output of the difference forming unit, a first transform unit with an input and with an output being operationally interconnected between the adaption control input and the output of the difference forming unit, a second transform unit with an input and with an output being operationally interconnected between the input of the adaptive compensator filter unit and the output of the difference forming unit, an inverse transform unit with an input and with an output being operationally interconnected between the output of the adaptive compensator filter unit and the second input of the difference forming unit, said first and second transform units performing a fast orthogonal transformation on input signals in time domain into output signals in frequency domain, said inverse transform unit performing a transform being inverse to that of the transform units.

2. The apparatus of claim 1, wherein the second transform unit is interconnected between the output of the amplifier filter unit and the input of the adaptive compensation filter unit.

3. The apparatus of claim 1, wherein the second transform unit is interconnected between the output of the difference forming unit and the input of the amplifier filter unit and a further inverse transform unit is operationally interconnected between the input of the DAC and the output of the amplifier filter unit.

4. The apparatus of claim 3, wherein the first and the second transform units are formed by a single combined transform unit.

5. The apparatus of claim 3, wherein at least the second transform unit, the one and the further inverse transform units operate in the overlap-save technique.

6. The apparatus of claim 1, wherein the first transform unit operates in the overlap-add technique.

7. The apparatus of claim 4, wherein the combined transform unit operates in the overlap-add technique and its input is operationally connected to the output of the difference forming unit, its output is operationally connected to the adaption control input and to a block storage unit, wherein, successively, successive data blocks having been formed in the combined transform unit are stored, and further comprising an addition unit, wherein storage partitions of the store, which accord to respective data block partitions, are added under consideration of the signal, the output of the addition unit providing data blocks of overlap-save type and being operationally connected to the input of the amplifier filter unit.

8. The apparatus of claim 1, wherein the amplifier filter unit comprises an amplifier filter and a time-lag unit, the output of the amplifier filter being operationally connected to the input of the time-lag unit.

9. The apparatus of claim 7, wherein the adaptive compensation filter unit comprises an input and a series of time-lag stages, the input of the first time-lag stage of the series being operationally connected to the input of the adaptive compensation filter unit, $1 \leqq i \leqq L$ partial compensator units, wherein partial estimation signals $$\bar{Y}_i[k+1] \text{ for } 1 \leqq i \leqq L$$

are generated, wherein k stands for the number of data blocks counted at the output of the combined transform unit, an addition unit, wherein the partial estimation signals $\bar{Y}_i[k+1]$ generated by the L partial compensators are added, the output of the addition unit being the output of the adaptive compensator filter unit.

10. The apparatus of claim 9, comprising a series of partial compensators, the input of the first of the series of partial compensators being operationally connected to the input of the adaptive compensation filter unit and the input of each partial compensator of the series of partial compensators being connected to its output via a time-lag stage of the series of time-lag stages.

11. The apparatus of claim 10, wherein each partial compensator comprises:

a first multiplication unit with a first and a second input and with an output, the first input being operationally connected with the output of the partial compensator, a second multiplication unit with a first and with a second input and with an output, the first input being operationally connected with the output of the first multiplication unit, the second input being operationally connected with the adaption control input, whereby the output of the second multiplication unit is operationally connected via an accumulation unit to a first input of a third multiplication unit, the second input thereof being operationally connected with the input of the partial compensator, the output thereof being operationally connected to an input of the addition unit of the adaptive compensation filter.

12. The apparatus of claim 3, wherein the output of the second transform unit is further operationally connected to the input of a signal power monitoring unit, the output of which controlling the effect of a signal applied to the adaption control input in dependency of whether the signal power measured reaches or does not reach a predetermined threshold value.

13. The apparatus of claim 11, wherein the second input of the first multiplication unit is operationally connected to the output of a fourth multiplication unit with a first and a second input, to the first input of which a signal according to a reference step width is fed, the second input thereof being operationally connected to the output of a scaling unit, which scaling unit being operationally connected at its inputs with the outputs of two interpolation filters, to which interpolation filters the output signal of the amplification filter unit is fed via a signal power measuring unit.

14. The apparatus of claim 13, wherein, instead of the output signal of one of the interpolation filters, a signal which is constant in time is fed to the scaling unit.

15. The apparatus of claim 11, wherein an inverse transform unit, a hulling unit and a transform unit are interconnected between the output of the accumulation unit and the first input of the third multiplication unit.

16. The apparatus of claim 1, wherein the output of an amplitude limiting unit is operationally connected to the input of the EAC.

17. The apparatus of claim 3, wherein an amplitude limiting unit is operationally connected between the output of the amplifier filter unit and the input of the DAC.

18. The apparatus of claim 1, wherein a modelling unit, modelling at least one of EAC and AEC and operating in at least one of frequency and of time domain, is provided at least one of operationally connected to the input and of operationally connected to the output of the adaptive compensation filter unit, the modelling unit modelling the behaviour of the EAC and/or AEC.

19. The apparatus of claim 2, the output of an EAC- and/or AEC-modelling unit, modelling the EAC and/or AEC in the time domain, is operationally connected to the input of the second transform unit.

20. The apparatus of claim 2, wherein an input of an EAC- and/or AEC-modelling unit, modelling the EAC and/or AEC in the frequency domain, is operationally connected to the output of the second transform unit.

21. The apparatus of claim 1, wherein one modelling unit, modelling the EAC and/or AEC, is provided with its output operationally connected to the input of the adaptive compensation filter unit and another modelling unit, modelling the EAC and/or AEC, is provided with its input operationally connected to the output of the amplification filter unit.

22. The apparatus of claim 21, wherein at least one of the modelling units operate in the time domain.

23. The apparatus of claim 1, further comprising at least one modelling unit, modelling the behaviour of the EAC and/or of the AEC, the modelling unit comprising a linear transfer unit and a non-linear transfer unit.

24. The apparatus of claim 23, wherein the linear transfer unit comprises at least one amplifier and at least one filter.

25. The apparatus of claim 24, wherein the linear transfer unit comprises a prefilter substantially with low pass characteristic, the output of which being operationally connected to the non-linear transfer unit, the output of the non-linear transfer unit being operationally connected with a compensating filter unit with a frequency characteristic substantially inverse to the frequency characteristic of the prefilter.

26. The apparatus of claim 25, wherein the output of a linear amplification unit is operationally connected to the input of the non-linear transfer unit and a linear amplification compensating unit is operationally connected with its input to the output of the non-linear transfer unit, which linear amplification compensating unit compensating amplification of the linear amplification unit.

27. The apparatus of claim 1, comprising at least one limiter unit operating in at least one of time domain and of frequency domain and an energy supply battery arrangement, further comprising a determining unit for determining the momentarily battery state, the output of the determining unit controlling the at least one limiter unit at a control input thereof.

28. The apparatus of claim 1, wherein said DAC comprises a gain control input and comprising an energy supply battery, further comprising a determining unit for the momentarily state of the battery, the output of the determining unit being operationally connected to the gain control input of said DAC.

29. The apparatus of claim 1, comprising a modelling unit with at least one parameter control input, modelling the behaviour of the EAC and/or the AEC, further an energy supply battery and a determining unit for the momentarily state of the battery, the output of the determining unit being operationally connected to the at least one parameter control input of the modelling unit.

30. The apparatus of claim 29, wherein the modelling unit operates in time domain.

31. The apparatus of claim 1, wherein the output of a noise generator is operationally connected to the input of the adaptive compensation filter unit via a superposition unit.

32. The apparatus of claim 31, wherein the superposition is controlled.

33. The apparatus of claim 31, wherein time-spans, during which superposition occurs, are controlled.

34. The apparatus of claim 31, wherein the output signal of the noise generator is in the time domain or in the frequency domain.

35. The apparatus of claim 34, wherein the output of the amplification filter unit is operationally connected to the input of a shape detection unit, wherein the instantaneous shape of input signal frequency spectrum is monitored and wherein a check is performed whether the instantaneous shape accords with at least one predetermined condition or not, whereby the output signal of the shape detection unit controls the superposition.

36. The apparatus of claim 34, wherein the output of the noise generator is operationally connected with the superposition unit via a shaping filter, shaping amplitude and/or frequency distribution of the noise, shaping of the shaping filter being controlled by the instantaneous spectrum of the output signal of the difference forming unit.

37. A hearing aid apparatus, comprising:

an acoustical-to-electrical converter—AEC—, an electrical-to-acoustical—EAC—converter, an electrical transmission circuit operationally connecting the output of the AEC and the input of the EAC, the circuit comprising a noise generator and a superposition unit at which a signal dependent from the output signal of the noise generator is superimposed to a signal depending from a signal generated at the output of the AEC, the output of the noise generator being operationally connected to the superposition unit via a filter unit with a control input for its transmission characteristic, the control input being fed by a signal dependent on a signal generated at the output of said AEC, via a frequency spectrum monitoring unit.

38. The apparatus of claim 37, wherein the noise generator generates a noise signal in time domain and the filter unit is a linear filter unit.

39. The apparatus of claim 37, wherein the noise generator generates a noise in frequency domain and the filter is a spectrum shaping unit.

40. A hearing aid apparatus, comprising:

an acoustical/electrical converter—AEC—, an electrical/acoustical converter—EAC—, an electrical transmission circuit operationally connecting the output of the AEC to the input of the EAC and comprising at least one transform unit performing fast orthogonal transform from time domain into frequency domain on an electric signal dependent from a signal at the output of the AEC, a noise generator with an output, the output of the noise generator being operationally connected to a superposition unit at the frequency domain output side of the transform unit.

* * * * *